US005117985A

United States Patent [19]

Bluthardt et al.

[11] Patent Number: 5,117,985

[45] Date of Patent: Jun. 2, 1992

[54] STACKING RECEIVER FOR A SHEET FOLDING MACHINE

[76] Inventors: Edward A. Bluthardt, 6612 Lakepoint, Utica, Mich. 48089; Jeffrey L. Goins, Sr., 55605 Card Rd., New Haven, Mich. 48048; Noel Noble, 23313 Melville, Hazel Park, Mich. 48030

[21] Appl. No.: 641,056

[22] Filed: Jan. 14, 1991

[51] Int. Cl.[5] ..... A47F 5/00

[52] U.S. Cl. ..... 211/50; 211/181; 248/918

[58] Field of Search ..... 211/181, 13, 50; 248/676, 175, 918

[56] References Cited

U.S. PATENT DOCUMENTS

| | | | |
|---|---|---|---|
| 3,578,178 | 5/1971 | Absler et al. | 211/50 |
| 4,651,967 | 3/1987 | McCoy | 211/181 X |
| 4,861,213 | 8/1989 | Fuchs | 211/50 X |
| 4,938,447 | 7/1990 | Schriner | 248/918 X |

*Primary Examiner*—Robert W. Gibson, Jr.
*Attorney, Agent, or Firm*—John R. Benefiel

[57] ABSTRACT

A stacking receiver is disclosed for collecting and edgewise stacking of a succession of folded sheets exiting a slot on the folding machine, the receiver including an angled wire frame member pivotally mounted to be able to be swung to an up position in which the apex of a corner formed on each of a pair of legs is aligned opposite the slot. The member is spring urged to the up position, and is gradually lowered as successive sheets are fed beneath each other and accumulate in a stack, forced against a confinement section extending up from the corner apex, the sheets in the stack resting on a holder section extending horizontally as the member assumes a full down position. A second member provides an ascending ramp allowing the sheets to descend from the slot onto the holder section.

10 Claims, 2 Drawing Sheets

STACKING RECEIVER FOR A SHEET FOLDING MACHINE

This invention concerns a receiver for accepting folded sheets exiting from a folding machine, and more particularly for forming a stack from a succession of folded sheets exiting from the folding machine.

In U.S. Pat. No. 4,842,574 issued on Jun. 27, 1989 for "Buckle Chute Folder Having a Sheet Squaring Feature" there is described a machine which folds paper sheets fed into an entrance slot, by means of a series of rollers, which drive the folded sheet out through an exit slot.

Since such machines are usually employed when a large number of sheets are to be folded, it would of course be desirable to have a means for receiving the folded sheets and forming a neat stack for convenience in further handling.

Such a receiver should reliably handle each of the sheets in a succession of a hundred or more sheets. This requirement has in the past resulted in complex conveyor systems for handling each sheet and transferring the same to a stacking receptacle.

Thus, it is an object of the present invention to provide a stacking receiver as for a sheet folding machine which operates reliably, and yet is simple in configuration and operation.

SUMMARY OF THE INVENTION

The present invention is a stacking receiver for sheets comprised of a pair of interfit members.

A first, pivoted member is preferably provided by a U-shaped wireframe, including a pair of parallel legs extending down from a cross piece at the top. The lower ends of each leg is pivotally mounted to the front bottom of the folding machine to establish a swing mounting of the member, and is spring biased so as to be urged to a full up position with the crosspiece and upper end of each leg swung against the front of the machine.

Each leg of the first wire frame member is bent at its upper end to form a corner having its apex lying slightly below the exit slot of the folding machine with the member in its full up position. The lower end of each leg has an angled tip downwardly flared and extending over the bottom of the folding machine so as to provide a stop means limiting the extent of downward swinging motion to establish a full down position. An intermediate bend in each leg positions an intermediate holder section of each leg approximately horizontally in the full down position of the first wire frame member.

As the first folded sheet passes out from the exit slot of the folding machine it is driven against the corner apex of each leg, the distance thereto being slightly less than the folded lengthwise dimension of the sheets, so that the sheet bridges the gap between the corner apex and the exit slot of the machine and is thus supported on both sides.

The trailing edge of the folded sheet is held flared slightly upwardly so that the next exiting folded sheet is driven beneath the first folded sheet, as is each successively exiting folded sheet.

A stack of folded sheets accumulates on the receiver, forced against the angled upper end and holder sections of each leg by successive exiting folded sheets. As the stack builds, the first frame member is progressively swung downwardly against the spring bias to eventually reach the full down position.

A second fixed member is associated with the first pivotal member and is preferably provided by a wire frame which is fixedly attached to the rear of the folding machine and interfit with the first member, having a pair of spaced apart legs, each leg shaped with an angled section parallel to the other, positioned to form a ramp extending upwardly from the holder section of the first wire frame member to the exit slot of the folding machine.

As the first wire frame member is lowered to the full down position, the folded sheets are distributed descending down the ramp section and arched over to the exit slot, so that the folded sheets maintain a bridging relationship with the rear of the folding machine, and as thus fully supported.

The spring bias means can be selectively released, lowering the first wire frame member to the full down position, where it can act as a collection shelf for receiving folded papers from a second, much lower exit slot for bifolded papers processed by the folding machine.

DETAILED DESCRIPTION

In the following detailed description, certain specific terminology will be employed for the sake of clarity and a particular embodiment described in accordance with the requirements of 35 USC 112, but it is to be understood that the same is not intended to be limiting as the invention is capable of taking many forms and variations within the scope of the appended claims.

Figure 1:
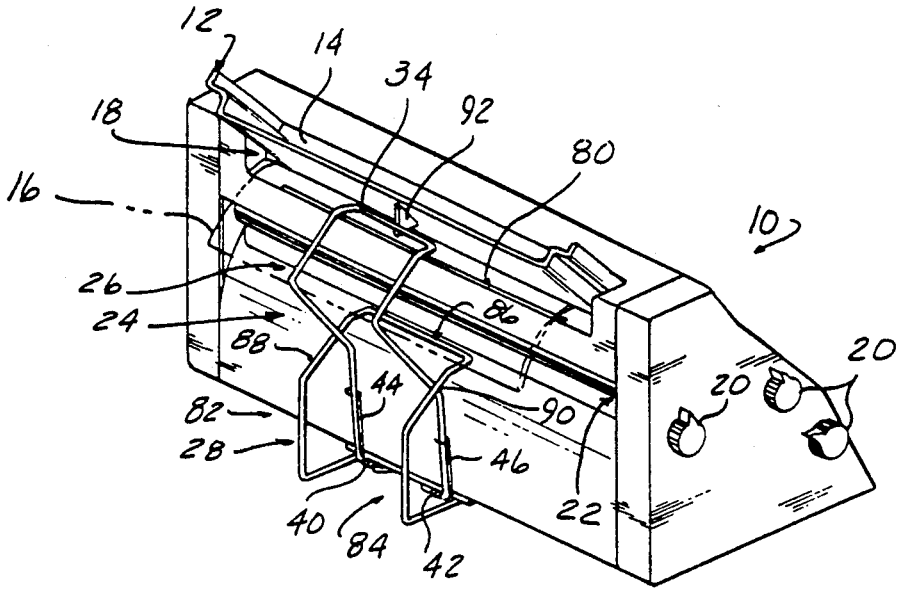
FIG. 1 is a front perspective view of a folding machine with a stacking receiver according to the present invention installed thereon, with an exiting folded sheet shown in phantom.

Referring to the Drawings, FIG. 1 shows the rear of a sheet folding machine 10 of the type described in the aforementioned U.S. Pat. No. 4,842,574. Unfolded sheets are inserted into a tray 12 and into an entrance slot 14 at the top of the machine 12. Folded sheets 16 are driven out of an exit slot 18 at the front of the machine 10. Alternate fold patterns may be produced by changing the settings of a series of control knobs 20, as for example a bifolded sheet may be produced, driven out of a lower exit slot 22.

A folding machine 10 is described fully in the aforementioned U.S. Pat. No. 4,842,574, and will not be described further here inasmuch as the details thereof do not form a part of the present invention.

The present invention concerns an accessory for such folding machines, comprised of stacking receiver 24 mounted to the front or exit slot side of the machine 10.

The receiver 24 shown is preferably formed of a pair of simple wire frame members, a first, pivotally mounted member 26 and second fixed member 28 interfit with the first member 26.

The first member 26 is positioned aligned with the slot 18, and is generally U-shaped, having a pair of legs 30, 32, shaped identically with a series of bends, each leg 30, 32 connected at their upper ends with an integral cross piece section 34. The legs 30, 32 are spaced apart to present a substantial width able to square a folded sheet 16 when the sheet is driven against the same.

The lower end of each leg 30, 32 is formed with short transverse section 36, 38 respectively, each receiving an encircling helical spring 40, 42. Each helical spring 40, 42 terminates at one end with a straight section 44, 46 extending up a respective leg 30, 32 and engaged therewith by a short partial loop 48, 50 formed at the en thereof.

The opposite end of each helical spring 40, 42 ends with a straight section of wire 52, 54 both clamped beneath a mounting plate 56 secured to the bottom of the machine 10 with screws 58 (FIGS. 3–6).

Figure 3:
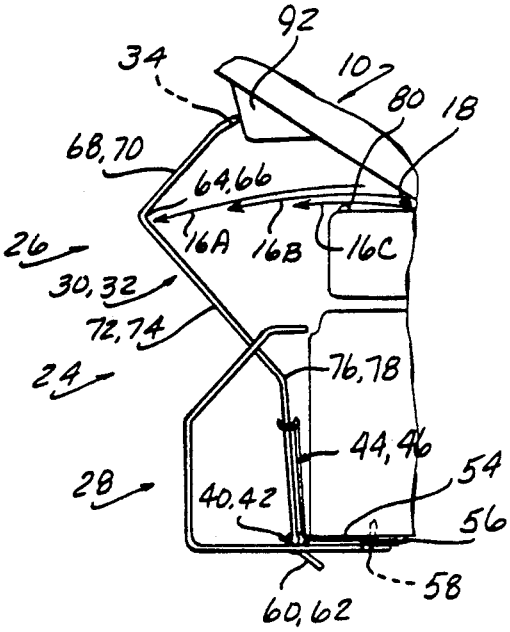
FIG. 3 is a side elevational view of the stacking receiver according to the present invention and fragmentary portions of a folding machine on which the stacking receiver is installed.

Each leg 30, 32 is thus pivotally mounted to the machine 10, and at the same time is spring biased to the full up position shown in FIGS. 1 and 3, with the crosspiece 34 juxtaposed to the machine 10.

Figure 2:
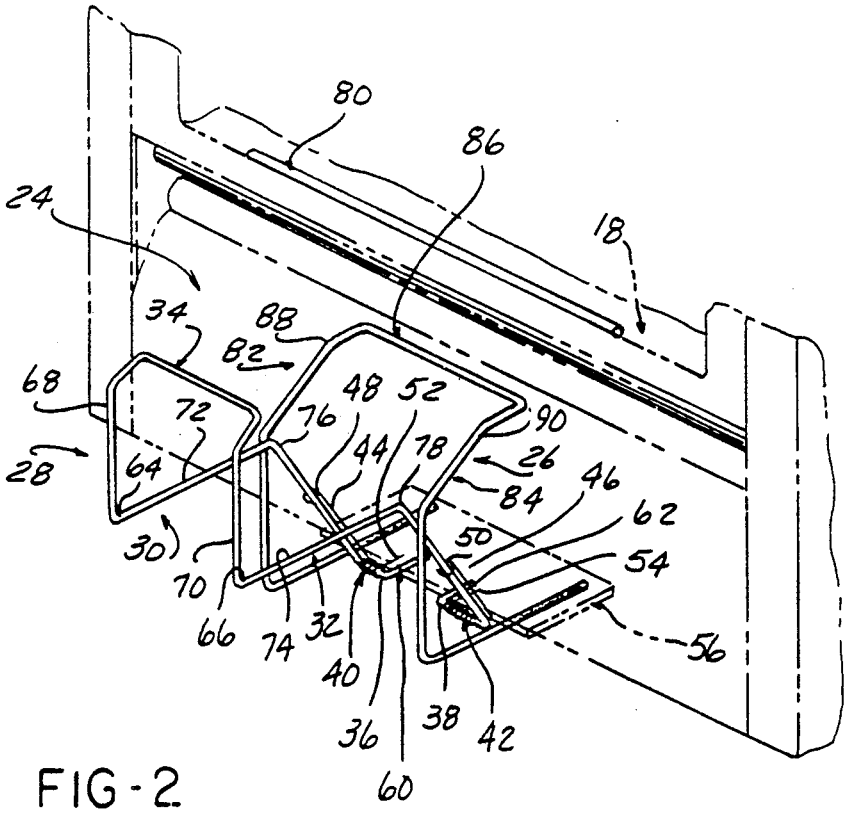
FIG. 2 is an enlarged front perspective view of the stacking receiver shown in FIG. 1, with a first wire frame member swung to a full down position, a fragmentary portion of the folding machine shown in phantom.
Figure 5:
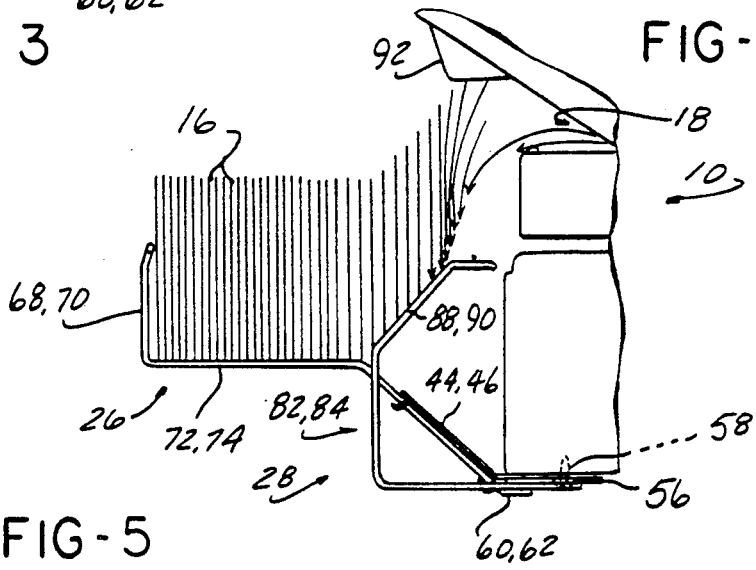
FIG. 5 is the side elevational view as in FIGS. 3 and 4, but with the first wire frame member swung to the full down position, a stack of folded sheets formed and a series of folded sheets descending the ramp section of the second wire frame member.

The first member 28 may be swung away against the bias of the springs 40, 42 to a full down position shown in FIGS. 2 and 5, upon engagement of terminal end 60, 62 of each leg 30, 32 with the bottom of the plate 56, each terminal end 60, 62, downwardly bent to allow limited pivoting movement of the first member 26, but acting as a stop in the full down position.

Each leg 30, 32 is formed with a 90° bend at its upper end to form a corner 64, 66. An upper confinement section 68, 70 extends to the crosspiece 34, with a final slight inward bend to aid in retaining a stack of folded sheets, as will be described.

An intermediate holder section 72, 74 is also formed in each leg 30, 32, defined by a lower slight outward bend 76, 78, and which when swung down, positions the holder section 72, 74 substantially horizontally and approximately at a level slightly lower than the height of a folded sheet 16 below the exit slot 18.

The apex of the corners 64, 66 is located opposite and slightly below the slot 18 so that a first folded sheet 16A driven out of the exit slot 18 engages the first member 26 at the corner apexes 64, 66. The distance of the corner apexes 64, 66 away from the exit slot 18 with the first member 26 in the full up position is less than the depth of the exiting folded sheet 16A, such that the sheet bridges the gap, maintaining the position of the folded sheet squared against the laterally spaced legs 30, 32.

The downward curving of the first exiting sheet 16A slightly lifts the trailing side of the sheet, accentuated by a ridge feature 80 atop the lower lip of the exit slot 18. The next and each succeeding folded sheet 16B, 16C is thus driven beneath the previously exiting sheet 16A, 16B as shown in FIG. 3.

Figure 4:
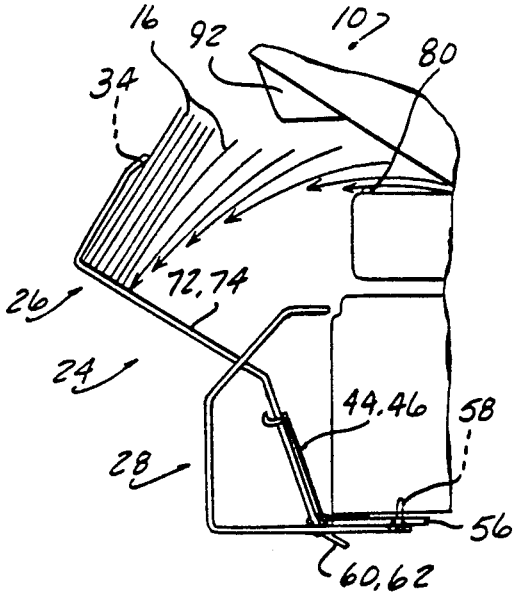
FIG. 4 is the side elevational view as described with respect to FIG. 3 but with the first wire frame member partially swung down, and with formation of a stack of folded sheets initiated.

As the folded sheets 16 accumulate, a stack forms, pushed flat against the confinement sections 68, 70 by the pressure of a series of succeeding folded sheets exiting one beneath the other and arching down to the corner formed by the partial stack and the holder sections 72, 74 as shown in FIG. 4.

The pressure exerted by the exiting folded sheets and the weight of the accumulating stacked sheets 16 causes progressive swinging out and lowering of the first member 26, until the full down position, shown in FIG. 5, is reached with the terminal ends 60, 62 in engagement with the plate 56.

At that point, the second wire frame member 28 comes into play.

The second member 28 is fixedly attached to the machine 10, by being welded to the plate 56. The second member 28 is also preferably a formed wire frame, generally U-shaped with a pair of legs 82, 84 connected with an integral crosspiece 86.

Each leg 82, 84 is formed with a ramp section 88, 90 inclined at approximately 45° from the vertical, and substantially intersecting the inside end of the holder sections (best seen in FIG. 5). These sections cause the succession of folded sheets 16 leading to the stack supported on the holder sections 72, 74 to be arrayed in descending fashion down the ramp. The several folded sheets are arched over to bridge the gap between the stack and the exit slot 18 as depicted in FIG. 5.

As successive folded sheets 16 are fed beneath the previous sheet, the stack is increasingly compressed and the series of folded sheets or the ramp section 88, 90 descend by gravity, until a fully compressed stack is formed.

A protuberance 92 on the underside of the tray 12 can assist confinement of the flared folded sheets, aiding in a smooth transition from the arched over condition to the full upright position of the on-edge folded sheets making up the stack.

Figure 6:
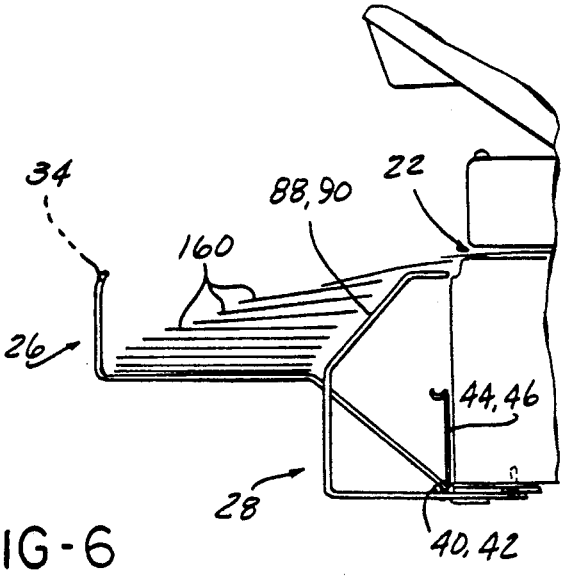
FIG. 6 is a side elevational view as described with respect to FIG. 3, but with the springs released and the first wire frame member swung to the full down position, and accumulation of folded sheets exited from a lower exit slot shown on the stacking receiver.

As an added feature, the springs 40, 42 can be disengaged from the respective legs 30, 32 of the first member 26 as shown in FIG. 6, letting the first member drop down to the full down position. Bifolded sheets 160 exiting the lower slot 22 can then be collected on the holder sections 72, 74 in a loose vertical stack, fast descending the ramp sections 88, 90 of the second member.

The wire frame construction is preferred for the first and second members 26, 28, because low cost manufacture can be achieved, but other configurations could of course be employed, such as molded plastic solid members with suitable alternate mounting arrangements.

We claim:

1. In combination, a stacking receiver for collecting sheets exiting from a horizontal slot formed on a machine structure, said receiver mounted to said machine structure and comprising:

a first member positioned aligned with said slot and of substantial width in the direction of said slot, so as to be able to square a sheet when driven thereagainst and to stably hold sheets deposited thereon;

mounting means mounting said first member to extend upwardly from a point below said slot, said mounting means including a pivot connection allowing swinging movement of said member towards and away from said slot between a full up position adjacent said slot and a full down position swung away from said slot;

said first member formed with a corner having the inside facing said slot and with the apex approximately aligned with said slot with said first member in said full up position;

said corner forming a confinement section and a holder section of said first member;

said confinement section extending upward from said holder section with said holder extending substantially horizontally with said first member in said full down position;

bias means urging said first member to said full up position;

and, means positioning the trailing edge of said sheets exiting said slot so that the next exiting sheet passes beneath the previously exiting sheet;

whereby a first sheet exiting said slot engages said corner apex, and successive exiting sheets accumulate on the machine side of said first sheet;

said first sheet eventually forced against said confinement section to begin to form a stack of sheets positioned on edge on said holder section, said first member being progressively swung away to said full down position as said sheets in said formed stack accumulate.

2. The combination of claim 1 further including ramp sections extending upwardly from said holder section with said first member in said full down position to a point adjacent said slot.

3. The combination according to claim 2 wherein said machine is a paper folding machine.

4. The combination of claim 1 wherein said first member comprises a formed wire frame including a pair of laterally spaced apart legs identically formed and connected at one end with a cross piece, the upper end of each of said legs formed identically with a corner and a confinement and holder section on either respective side of the apex of said corner, the lower end of each leg pivotally mounted to said machine structure by said mounting means.

5. The combination according to claim 4 further including a second member fixed to said frame, also including a generally U-shaped formed wire frame having a pair of side by side spaced apart and aligned legs straddling said first member, each leg having ramp sections inclined upwardly from said holder sections of said first member legs to said slot.

6. The combination according to claim 4 wherein each of said legs includes a laterally extending section at the lower end thereof; and wherein said bias means includes a pair of helical springs each received over a laterally extending section of a respective leg, each of said helical springs including portions causing a respective leg to be urged to said full up position.

7. The combination according to claim 6 wherein said portions are releasable from a respective leg to allow lowering of said first member to said lowered position.

8. The combination according to claim 4 wherein each of said legs is formed with a terminal section bent downwardly to allow swinging up of said first member but coming into engagement with said machine structure to provide a stop at said full down position limiting further travel of said first member.

9. A method of collecting and stacking a succession of sheets exiting in a direction of travel from a slot formed in a machine, comprising the steps of:

positioning a first member aligned with said slot, said first member having a substantial width in the direction of said slot;

said first member formed with an inside corner having the apex thereof approximately aligned with said slot and spaced from said slot a distance less than the dimension of said sheet measured in the direction of travel in a full up position of said first member;

mounting said first member to be able to be swung down and away from said slot, causing the corner to be lowered to a full down position, while urging said first member to said full up position;

feeding a first sheet out of said slot and into engagement with said apex, and feeding each successive sheet beneath the previously exiting sheet, gradually lowering said first member by the accumulation of sheets against a confinement portion thereof extending from said corner, said sheets deposited on edge on a holder section of said first member extending inwardly from the apex of said corner.

10. The method according to claim 9 further including the step of forming a descending series of sheets exited from said slot on a ramp section extending upwardly from said holder section to said slot.

* * * * *